United States Patent [19]

Anthony et al.

[11] 4,092,087

[45] May 30, 1978

[54] AIR OPERATED PUMP

[76] Inventors: David S. Anthony, 1235 W. Laurel, San Antonio, Tex. 78201; Leonard M. Turner, Jr., Box 52, Von Ormy, Tex. 78073

[21] Appl. No.: 750,445

[22] Filed: Dec. 14, 1976

[51] Int. Cl.[2] ..... F04F 1/08

[52] U.S. Cl. ..... 417/131; 417/147

[58] Field of Search ..... 417/131, 138, 147, 133, 417/126, 132, 118

[56] References Cited

U.S. PATENT DOCUMENTS

| | | | |
|---|---|---|---|
| 2,007,745 | 7/1935 | Coy et al. | 417/131 |
| 2,209,617 | 7/1940 | Thomas | 417/131 X |
| 2,223,417 | 12/1940 | Havens | 417/131 |
| 3,138,113 | 6/1964 | Arutunoff | 417/131 X |
| 3,415,199 | 12/1968 | Elliott et al. | 417/131 X |

*Primary Examiner*—Carlton R. Croyle
*Assistant Examiner*—Richard E. Gluck
*Attorney, Agent, or Firm*—John C. Stahl

[57] ABSTRACT

A generally elongated cylindrical pump adapted to be lowered into a fluid producing formation comprising a hollow annular outer chamber circumferentially about a hollow cylindrical inner chamber, a valve mounted in said inner chamber, a source of compressed gas adapted to be applied to said valve, a float reciprocally mounted in said inner chamber coacting with said valve to apply said compressed gas to said inner chamber when said float is raised to a predetermined height and the fluid is then forced through said outer chamber to an outlet bore; the compressed gas applied to said inner chamber is cut off when such pumping operation is completed.

11 Claims, 9 Drawing Figures

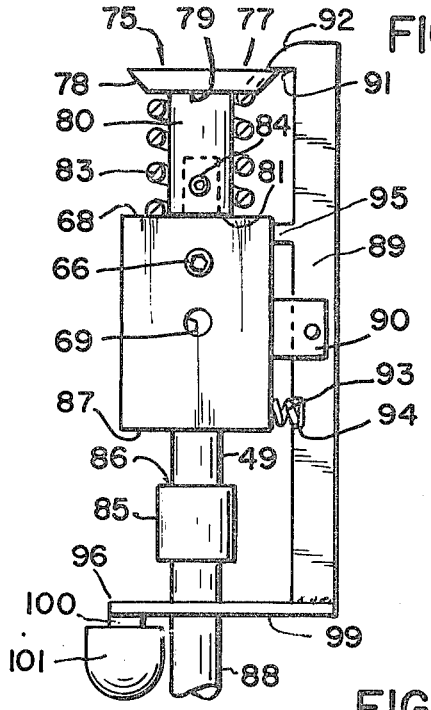
FIG. 6
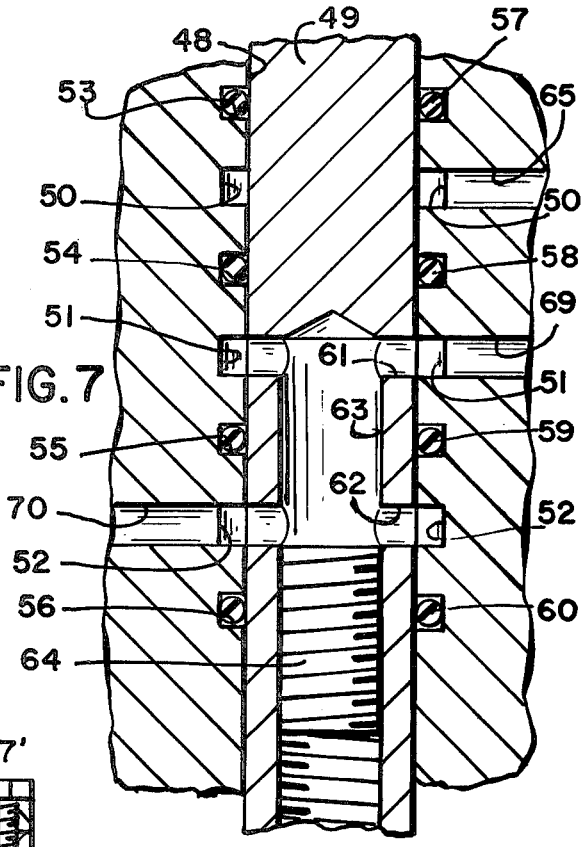
FIG. 7
FIG. 9
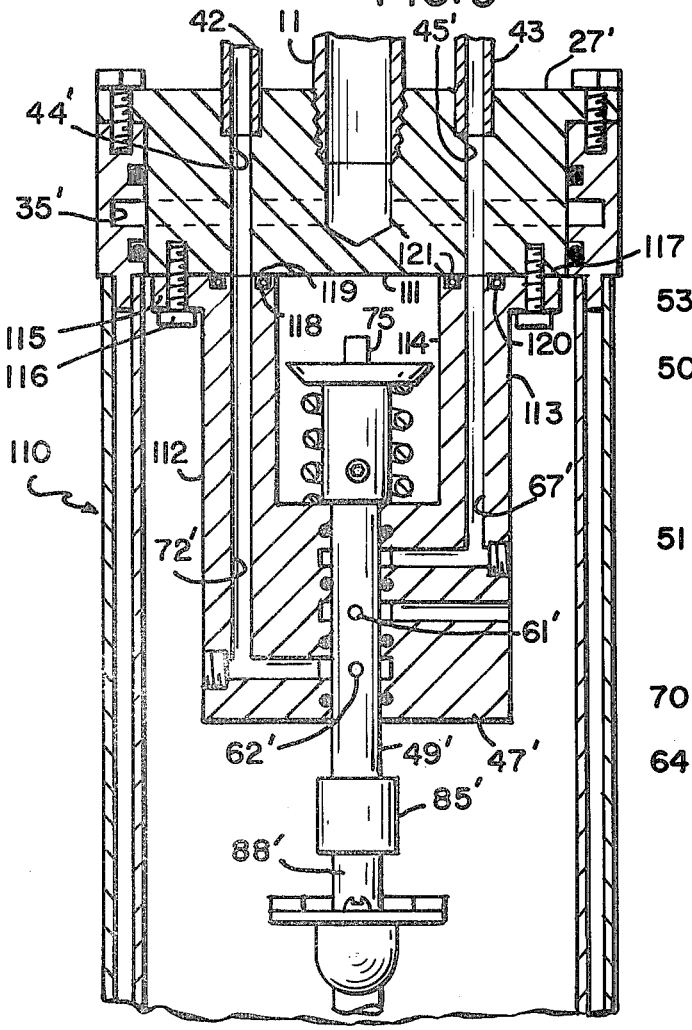
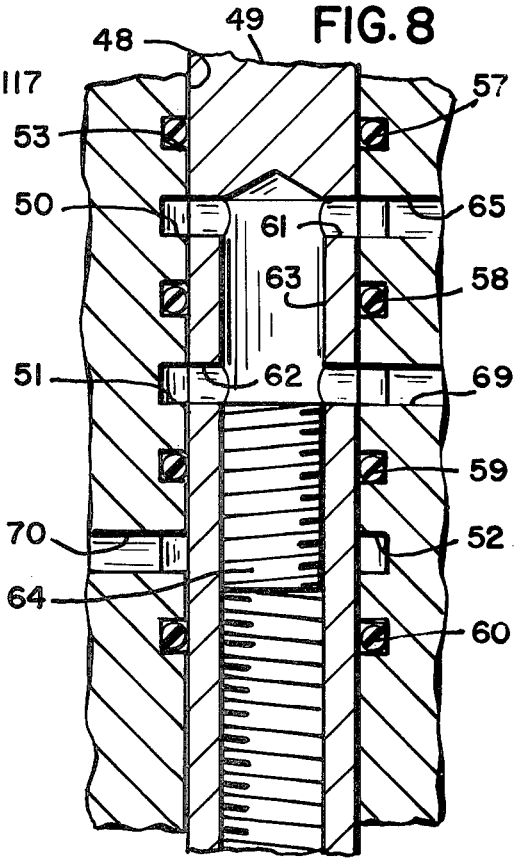
FIG. 8

AIR OPERATED PUMP

BACKGROUND OF THE INVENTION

Heretofore many oil wells having marginal production have been shut in due to the relatively high cost of pumping said wells utilizing conventional equipment and techniques. It is well known that the production from any selected well is not consistent therefore a pumper, on a fixed schedule, is not likely to pump said well at the most opportune time to obtain maximum production. Furthermore, although mechanical and electric timers have been used to periodically activate the pumps in an attempt to replace the pumper, this combination has the attendant disadvantages heretofore mentioned and frequent inspection of the equipment at the well site is still required.

Although gas operated pumps have heretofore been used for many applications, in continuous supply of compressed gas is normally used and the cost of such continuous operation, especially when higher operating pressures are required, is relatively expensive.

SUMMARY OF THE INVENTION

The principal object of the invention is the provision of a gas operated down hole pump capable of pumping fluids from shallow wells to relatively deep wells at relatively low operating gas or air pressures.

Another object of the invention is to provide such a pump which is activated when the fluid reaches a predetermined height in said pump.

Still another object is to provide such a pump wherein compressed gas or air is applied to said pump only during pumping operations and is effectively cut off at all other times.

A further object is to provide such a pump which is relatively inexpensive to manufacture, capable of operation over extended periods of time with a minimum of maintenance and repair, and universal in its adaptability.

Other objects and features of the invention will become apparent to those skilled in the art from a consideration of the following specification when read in the light of the annexed drawings.

BRIEF DESCRIPTION OF THE DRAWINGS

FIG. 6 is a side elevational view, partly in section, of the valve body.

FIG. 7 is a greatly enlarged, vertical sectional view through the valve body and valve stem, showing the valve stem in the lower, secured position.

FIG. 8 is a greatly enlarged, vertical sectional view through the valve body and valve stem, showing the valve stem in the upper position.

FIG. 9 is a fragmentary, greatly enlarged vertical sectional view through the upper portion of another embodiment of pump of the subject invention.

DESCRIPTION OF PREFERRED EMBODIMENTS

Figure 1:
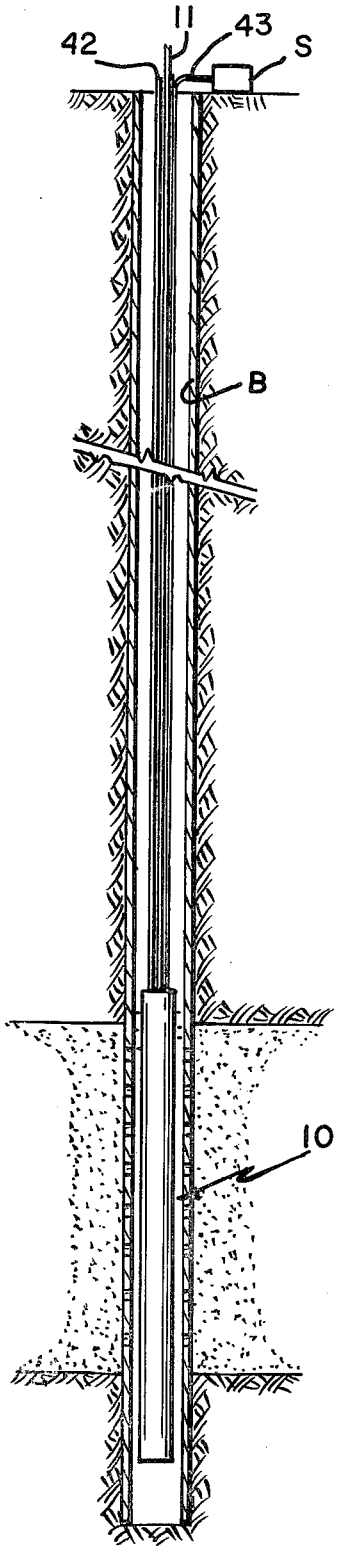
FIG. 1 is a pictorial view showing the pump of the subject invention positioned in a well bore and extending into a formation from which fluid is to be produced.

Referring now to the drawings, wherein like reference characters designate like or corresponding parts throughout the several views, there is shown in FIG. 1 a gas operated fluid pump 10 adapted to be lowered into a well bore B by means of tubing string 11 and at least partially extend into a formation from which oil or other fluid is to be produced.

Pump 10, of desired length and such outside diameter to fit within well bore B in a relatively close fit, terminates downwardly in base plate 12 of desired diameter. The lower end of hollow cylindrical outer casing 13 is secured in annular recess 14 circumferentially about the upper surface of said base plate. Ball check valve 15 includes male threads 16 exteriorly thereof which screw into axially extending and tapered threads 17 passing through said base plate. In closed condition, ball 18 is adapted to bear against seat 19; a diagonally extending rod 20 is secured to selected parts of said valve substantially above the ball and prevents displacement thereof from said valve.

Annular ring 21, of the same outside diameter as base plate 12, terminates downwardly in an integrally formed and depending annular skirt 22 of reduced diameter which inserts into the bore of said outer casing 13 and is secured thereto. Hollow cylindrical inner casing 23 is mounted concentrically within the outer casing with the upper edge passed interiorly of skirt 22 and secured thereto; the lower edge of casing 23 is spaced at least slightly above said base plate. It is understood that the outer and inner casings heretofore described are fixedly or detachably secured to the aforementioned portions of the annular ring and base plate, respectively, in any conventional manner which provides an airtight and liquid tight connection between said members. A plurality of spacers 24 are fixedly secured to selected portions of the outer surface of the inner casing in proximity to the lower edge thereof and/or the corresponding inner surface of the outer casing; a downwardly opening, longitudinally extending and hollow annular chamber 25 is thus formed intermediate said outer and inner casings and axially extending, hollow cylindrical chamber 26 formed inwardly of casing 23.

Cap 27, corresponding in outside diameter to ring 21, includes reduced diametral cylindrical section 28 which inserts into ring 21 in a relatively tight fit and desirably terminates downwardly in proximity to the lower end of said ring. Cap screws 29 pass downwardly through a plurality of longitudinally extending bores 30 spaced circumferentially about said cap and mate with aligned female threads 31 in said ring. In a modification of the invention, an annular ring and base plate detachably secured thereto, substantially similar in construction to ring 21 and cap 27, may be provided on the lower end of said pump. Alternatively, the lower end of the inner casing may be secured to the base plate and a plurality of circumferentially spaced slots or bores provided through the lower portion thereof.

Figure 3:
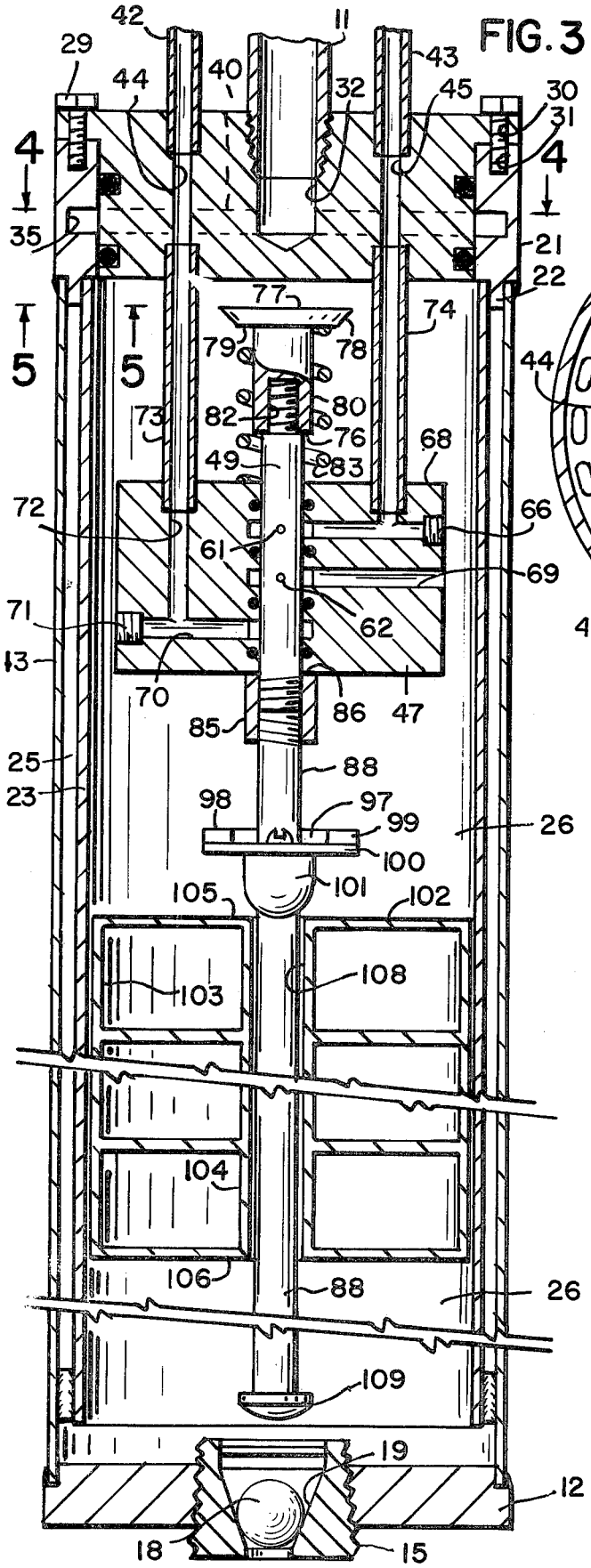
FIG. 3 is a fragmentary, greatly enlarged vertical sectional view through the pump of FIG. 1, showing the valve stem in the upper position.
Figure 4:
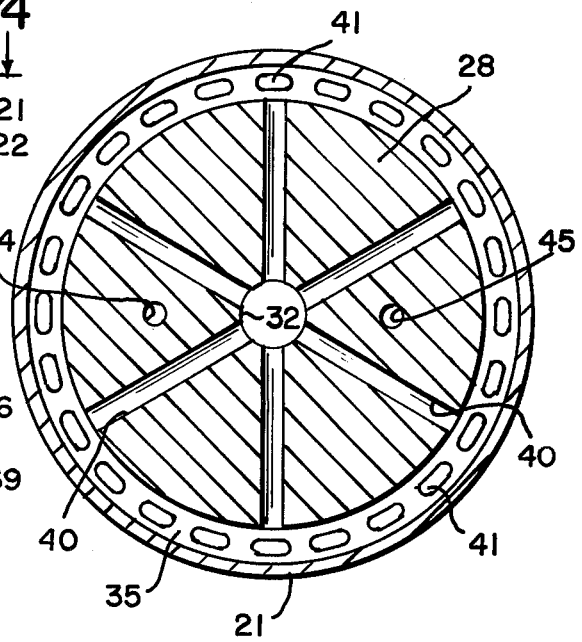
FIG. 4 is a horizontal sectional view, taken on the line 4—4 of FIG. 3, looking in the direction of the arrows.
Figure 5:
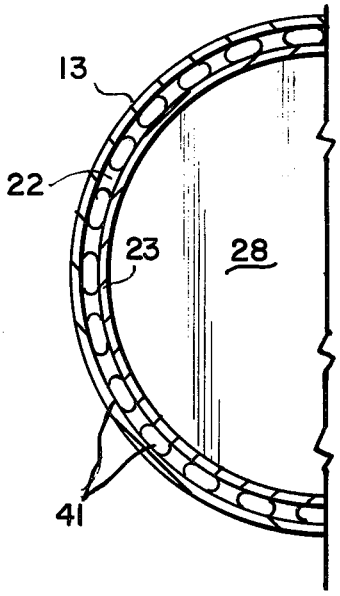
FIG. 5 is a horizontal sectional view, taken on the line 5—5 of FIG. 3, looking in the direction of the arrows.

Axial bore 32 passes downwardly and substantially through cap 27 with the upper portion at least partially provided with tapered threads 33 which accommodate the corresponding male threads 34 on the lower portion of tubing string 11. As best seen in FIGS. 3 and 4 of the drawings, annular groove 35 is provided in the approximate medial portion of the inner surface of ring 21. Annular grooves 36–37 in section 28, paralleling and vertically spaced at least slightly above and below the plane of groove 35, carry O-rings 38–39, respectively, which form a seal with the corresponding inner surface of said ring. A plurality of diagonally extending passages 40 in section 28 communicate with the lower portion of bore 32 and laterally with groove 35 in the ring. Furthermore, a plurality of vertically extending slots 41 or the like pass through skirt 22 and surface upwardly in groove 35 thereby forming a continuous passageway from chamber 25, through slots 41 to groove 35, and thence through passages 40 to axial bore 32.

Tubing 42–43 of desired inside diameter pass down the well bore B and communicate with vertical bores 44–45 in selected portions of said cap; valve 46, carried in chamber 26 and positioned a desired distance below said cap, remotely communicates with bores 44, 45. Valve body 47 of desired shape and size includes longitudinally extending bore 48 with valve stem 49 reciprocally mounted therein. Transversely extending and equidistantly spaced annular grooves 50–52 are provided in the approximate medial portion of bore 48; annular grooves 53–56, paralleling and spaced a desired distance above and below each groove 50–52, respectively carry O-rings 57–60 to effect a sliding seal with the walls of said valve stem.

Figure 2:
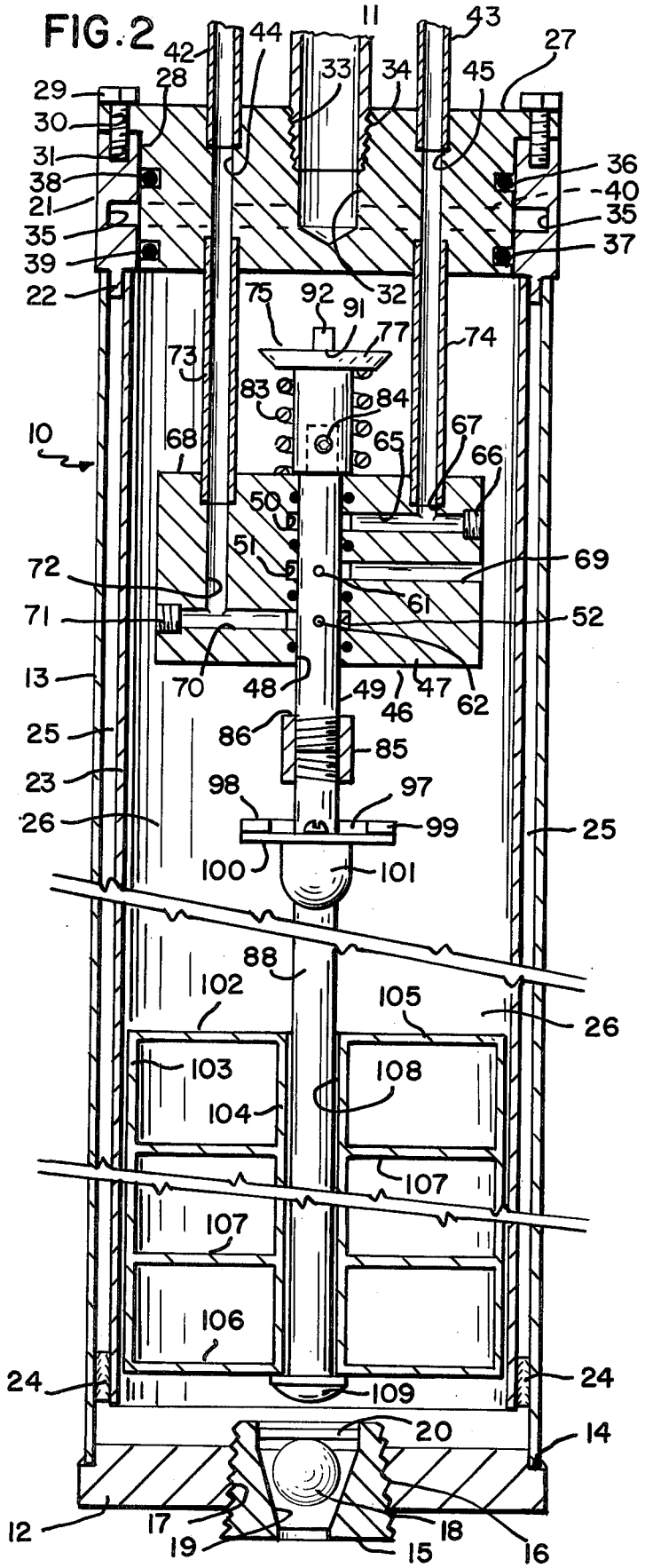
FIG. 2 is a fragmentary, greatly enlarged vertical sectional view through the pump of FIG. 1, showing the valve stem in the lower, secured position.

As best seen in FIGS. 2, 7 and 8 of the drawings, a first plurality of diagonally extending passages 61 are provided in the approximate medial portion of valve stem 49 with a second plurality of diagonally extending passages 62 spaced vertically therebelow and desirably vertically aligned therewith; an axially extending bore 63 communicates with passages 61, 62; plug 64 or the like is provided in said bore at least slightly below the plane of passages 62. In the normal, downwardly secured position of the valve stem (see FIG. 7), passages 61 in said valve stem communicate with groove 51 in the valve body and passages 62 communicate with groove 52; in the upward position of the valve stem (see FIG. 8), passages 61 communicate with groove 50 and passages 62 communicate with groove 51, respectively, whereby compressed gas or air is applied to chamber 26.

It is to be understood that the positioning of the several bores in the cap and valve body is merely exemplary and not in limitation of the scope of the invention. Bore 65 communicates inwardly with groove 50 with the outer end closed by means of plug 66 or otherwise conventionally sealed; bore 67, desirably surfacing in top 68 of said valve body, communicates with bore 65. Bore 69 communicates inwardly with groove 51 and surfaces in the side or other selected portion of said valve body. One end of bore 70 communicates with groove 52 while the opposite end is closed by means of plug 71 or otherwise conventionally sealed; bore 72 desirably surfaces in top 68 of said valve body and communicates with bore 70. As heretofore mentioned, tubing 42 communicates with bore 44 in said cap; tubing 73 of desired length communicates with the opposite end of bore 44 and bore 72 in the valve body. In like manner, tubing 43 communicates with one end of bore 45 in the cap while tubing 74 communicates with the opposing end of bore 45 and bore 67 in said valve body. It is evident that valve 46 may be desirably positioned within chamber 26 by varying the length of tubes 73, 74 and the capacity of the pump is at least partially determined thereby.

In a modification of the valve body, a plurality of annular bushings of desired height are fixedly secured in bore 48 in spaced relationship with O-rings or the like carried between adjacent bushings; bores may be provided through selected bushings to communicate with the coacting elements of the valve stem.

Spool 75 is adapted to be detachably secured to threaded portion 76 on the upper end of said valve stem. More specifically, spool 75 includes circular top 77, downwardly converging sides 78, annular base 79 paralleling top 77, and depending cylindrical shaft 80 which terminates downwardly in base 81; axially extending female threads 82 at least partially extend upwardly into said shaft. Spring 83, either cylindrical or tapered and carried on shaft 80, bears against top 68 of said valve body and base 79 of said spool and urges the said spool in an upward direction. As shown in FIG. 3, base 81 of the spool is spaced a desired distance above top 68 and the spool secured in such position by adjusting set screw 84 to bear against said threaded portion. In the lower, secured position of the valve stem, illustrated in FIGS. 2 and 7 of the drawings, base 81 of the spool abuts top 68 of the valve body and serves as a lower limit stop for said valve stem and aligns the several elements in the valve stem and valve body. Cylindrical collar 85 is secured to the lower end of said valve stem and serves as an upper limit stop for said valve stem when the upper edge 86 of said collar abuts bottom 87 of said valve body. Rod 88 hereinafter to be more fully described is secured to the lower end of collar 85.

Referring now to FIGS. 2 and 6 of the drawings, lever arm 89 is pivotally mounted on bracket 90 secured to the approximate medial portion of the rear or side wall of the valve body. Base 91 and arcuate, rearwardly inclined shoulder 92 on the upper end of lever arm 89 extend substantially above the top of said valve body. Spring 93, secured outwardly in recess 94 in the inner surface of lever arm 89 downwardly of bracket 90, bears against the adjacent surface of the valve body whereby the lever arm is normally biased inwardly; at such time base 91 at least partially overlies the marginal portion of the top 77 of said spool and secures the valve stem in the lower position illustrated in FIG. 2 of the drawings. Standoff 95 is formed on the inner surface of the lever arm above bracket 90 and is adapted to bear against the adjacent surface of the valve body as a forward limit stop for said lever arm; alternatively, a boss may be formed on or fixedly secured to the valve body above bracket 90 and is adapted to bear against the adjacent surface of said lever arm to accomplish such purpose.

U-shaped member 96 comprises cross member 97 and parallel arms 98–99 adapted to pass laterally of rod 88; the lower end of lever arm 89, terminating downwardly in proximity to collar 85, is fixedly secured to the approximate center of cross member 97. Transversely extending bar 100, positioned forwardly of rod 88, is secured to the foremost ends of arms 98, 99 with a downwardly depending button 101 of Teflon or other plastic composition conventionally secured to the approximate medial, lower surface thereof.

An essentially hollow, cylindrical float 102 of desired height is reciprocally mounted in chamber 26 in a relatively loose fit and is adapted to rise and fall with the fluid contained in said chamber. More specifically, float 102 includes hollow cylindrical outer wall 103, hollow cylindrical inner wall 104 concentric therewith, and top and bottom annular plate 105–106 secured thereto to form a closed, liquid and airtight member. A plurality of transversely extending and longitudinally spaced annular plates 107 are desirably secured intermediate walls 103, 104 of said float for additional strength and rigidity. Rod 88 is passed through bore 108 of inner wall 104 and said float moves vertically within chamber 26 dependent upon the fluid level therein. The downward travel of said float is limited by expanded portion 109 on the lower end of said rod which is in relative close proximity to the upper surface of the base plate in the downward, secured position of the valve stem as illustrated in FIG. 2 of the drawings.

An elastic medium under pressure, such as supplied by compressed gas or air source S, in the range of 25–350 p.s.i., is connected to tubing 43. It is understood that tubing 42 may extend outwardly of the well bore B or terminate any desired distance above pump 10 to prevent fluids from entering bore 44 in the cap. Alternatively, a conventional valve may be provided to accomplish such purpose.

At the beginning of each cycle, the valve stem is in the downward, secured position illustrated in FIGS. 2 and 7 of the drawings; the source of compressed gas or air is applied only to the uppermost annular groove 50 in the valve body, and bottom plate 106 of the float abuts expanded portion 109 on the rod. During all times that fluid enters into the lower portion of the pump through valve 15, and air or gas in chamber 26 is vented to the atmosphere by means of a continuous passageway comprising bore 69, groove 51, passages 61, bore 63, passages 62, groove 52, bore 70, bore 72, tubing 73, bore 44 and tubing 42 or the like. Float 102 is buoyed up by the fluid in chamber 26 and such fluid also extends upwardly into chamber 25 to an approximate corresponding height. At such time that top plate 105 of said float forceably bears against button 101, the upper end of said lever arm is pivoted outwardly and base 91 disengaged from top 77 of the spool; the valve stem is forced into the upper position illustrated in FIGS. 3 and 8 of the drawings by spring 83 and the upper edge 86 of collar 85 serves as an upper limit stop therefor when abutting the bottom of the valve body. In the upper position of the valve stem, groove 52 is closed off and the passageway from the inner chamber to tubing 42 is interrupted. The source of compressed gas or air which is normally applied to the uppermost annular groove 50 is then applied through the continuous passageway formed by passages 61, bore 63, passages 62, groove 51 and bore 69 into chamber 26. The fluid in chamber 26 which normally extends at least partially upwardly about float 102 and into bore 108 is forced downwardly whereby valve 15 is closed and said fluid is then forced upwardly under pressure through channel 25 and thence through slots 41, annular groove 35, passages 40, axial bore 32 and tubing string 11 into a storage tank or fluid collection system.

As the liquid level falls, float 102 correspondingly moves downwardly, top plate 105 pulls away from button 101 and the lower portion of lever arm 89 remotely connected thereto is forced outwardly by spring 93 until stopped by standoff 95 on the upper end thereof bearing against the adjacent surface of the valve body. At such time, top 77 of spool 75 is above the plane of base 91 of the lever arm. When bottom plate 106 of the float bears against expanded portion 109 of said rod, the combined weight of the float and rod pulls valve stem 49 downwardly; angularly inclined side 78 of the spool, bearing against arcuate shoulder 92 on the lever arm, forces said lever arm outwardly against the force exerted by spring 93; when the top of said spool clears base 91, the lever arm pivots inwardly, base 91 engages the top marginal portion of said spool, and the valve stem is secured in the lower position preparatory to another cycle.

It is understood that one or more valves may be selectively positioned in tubing string 11 to prevent fluid from flowing downwardly into pump 10 when the source of compressed gas is cut off. Furthermore, means may be provided on the base plate or any other selected portion of the pump to maintain said pump at least slightly above the bottom of the well bore and/or screen the fluid entering said pump.

There is shown in FIG. 9 another embodiment of pump 110 constructed in accordance with the principles of the invention. More particularly, cap 27' substantially similar to cap 27 heretofore described includes bores 44'–45' passing therethrough which surface downwardly in base 111 of said cap. Valve body 47', substantially similar to valve body 47 heretofore described in detail, includes integrally formed and laterally spaced sections 112-113 of desired shape and size with recess 114 therebetween to accommodate valve stem 49' and its associated members. Sections 112, 113 terminate upwardly in the same transverse plane. One or more lugs 115 are formed on each section 112, 113; cap screws 116 pass upwardly therethrough and screw into aligned and mating female threaded portions in said cap. Bore 72' in section 112, aligned with bore 44' in said cap, surfaces in top 117; annular groove 118 about bore 72' accommodates O-ring 119 to effect a seal about said bore with the corresponding portion of base 111 of said cap. Bore 67' in section 113 is aligned with bore 45' in said cap; annular groove 120 about bore 67' carries O-ring 121 to effect a seal about said bore with the corresponding portion of base 111.

It should be understood, of course, that the foregoing disclosure relates to only preferred embodiments of the invention and that it is intended to cover all changes and modifications of the invention herein chosen for the purposes of the disclosure which do not constitute departures from the spirit and scope of the invention.

What is claimed is:

1. A pump adapted to be lowered into a fluid producing formation in a well bore with a source of compressed gas applied thereto comprising an elongated hollow cylindrical casing secured downwardly to a base plate and upwardly to an annular ring, a cylindrical inner casing secured upwardly to said ring and terminating downwardly at least slightly above said base plate, a hollow annular outer chamber formed intermediate said outer and inner casings, a cap secured to said ring, first and second openings in said cap communicating respectively with atmosphere and said source of compressed gas, an inner cylindrical chamber formed inwardly of said inner casing, a continuous passageway in said cap and annular ring communicating with said outer chamber, a valve in said inner chamber commucating with said first and second openings, said valve comprising a valve body and a valve stem reciprocally mounted therein, an elongated rod connected to said valve stem, a float reciprocally mounted in said inner chamber on said rod, a second valve in said base plate, at least first and second passageways in said valve body whereby in a first position of said valve stem said first passageway is open and gas is bled from said inner chamber and discharged through said first opening, said second passageway is closed and said source of compressed gas is cut off, and said fluid is adapted to enter said second valve into said pump, said float adapted to rise to a predetermined height in said inner chamber and move said valve stem to a second position at which time said first passageway is closed, said source of compressed gas is applied through said second opening and second passageway to said inner chamber, said second valve in said base plate is closed, and said fluid forced upwardly through said outer chamber and said continuous passageway to a selected portion of said cap.

2. The invention of claim 1 further including means to secure said valve stem in said first position.

3. The invention of claim 1 wherein the combined weight of said rod and float pulls the said valve stem downwardly into the first position.

4. The invention of claim 1 wherein said valve body is remotely connected to said cap.

5. The invention of claim 1 wherein said valve body is mounted on said cap.

6. A pump adapted to be lowered into a fluid producing formation in a well bore with a source of compressed applied thereto comprising a cylindrical outer casing secured downwardly to a base plate and upwardly to an annular ring, an inner casing secured upwardly to said ring and terminating downwardly at least slightly above said base plate, a hollow annular outer chamber formed intermediate said outer and inner casings, a cap secured to said ring, an inner cylindrical chamber formed inwardly of said inner casing, an inwardly opening annular groove in said ring, at least first and second openings and an axial bore in said cap, passages in said cap communicating with said axial bore and said groove in said ring, a plurality of slots circumferentially about said ring communicating with said outer chamber and said groove in said ring, a valve in said inner chamber communicating with said first and second openings in said cap, said valve comprising a valve body and a valve stem reciprocally mounted therein, a float reciprocally mounted in said inner chamber, a second valve in said base plate, means securing said valve stem in a first position whereby said first opening in said cap communicates with said inner chamber to bleed gas therefrom when fluid is entering into said pump through said second valve, said source of compressed gas adapted to be applied to said second opening in said cap and normally cut-off when fluid is entering into said pump, in a second position of said valve stem said source of compressed gas applied to said inner chamber thereby closing said second valve in said base plate and forcing fluid in said pump through said outer chamber and thence said plurality of slots and passages into said axial bore in said cap.

7. The invention of claim 6 further including a tubing string adapted to connect to said axial bore whereby said pump may be lowered into said well bore.

8. The invention of claim 6 wherein said valve body is remotely connected to said cap.

9. The invention of claim 6 wherein said valve body is mounted on said cap.

10. The invention of claim 6 further including means to secure said valve stem in said first position.

11. The invention of claim 6 wherein said float is reciprocally mounted on a rod connected to said valve stem, the combined weight of said rod and float pulls the said valve stem downwardly into the first position.

* * * * *